US005231942A

United States Patent [19]

Beau et al.

[11] Patent Number: 5,231,942

[45] Date of Patent: Aug. 3, 1993

[54] SEWING MACHINE HOUSING WITH REMOVABLE INNER FRAMEWORK

[75] Inventors: Ingeborg Beau, Versoix; Michel Combepine, Les Avanchets; Antonio Jimenez, Meyrin, all of Switzerland

[73] Assignee: Mefina S.A., Switzerland

[21] Appl. No.: 820,650

[22] PCT Filed: May 17, 1991

[86] PCT No.: PCT/CH91/00119

§ 371 Date: Jan. 17, 1992

§ 102(e) Date: Jan. 17, 1992

[87] PCT Pub. No.: WO91/18139

PCT Pub. Date: Nov. 28, 1991

[30] Foreign Application Priority Data

May 23, 1990 [CH] Switzerland ..... 1763/90-9

[51] Int. Cl.[5] ..... D05B 75/00

[52] U.S. Cl. ..... 112/258

[58] Field of Search ..... 112/258, 259, 220

[56] References Cited

U.S. PATENT DOCUMENTS

| | | | |
|---|---|---|---|
| 2,946,302 | 7/1960 | Krasnitz . | |
| 4,274,349 | 6/1981 | Doyel . | |
| 4,552,081 | 11/1985 | Vartoukian et al. | 112/258 |
| 5,140,918 | 8/1992 | Combepine et al. | 112/258 |

FOREIGN PATENT DOCUMENTS

| | | |
|---|---|---|
| 337952 | 10/1989 | European Pat. Off. . |
| 1101788 | 10/1955 | France . |
| 1510353 | 1/1968 | France . |

*Primary Examiner*—Clifford D. Crowder
*Assistant Examiner*—Paul C. Lewis
*Attorney, Agent, or Firm*—Cushman, Darby & Cushman

[57] ABSTRACT

A sewing machine wherein the frame consists of a structure which forms one of the elements of the machine's housing and supports a strong framework which is movably attached to the structure by means of a plurality of clips which resiliently grip securing devices fastened to pairs of ridges which are part of the structure and receive the clips between them.

3 Claims, 5 Drawing Sheets

SEWING MACHINE HOUSING WITH REMOVABLE INNER FRAMEWORK

A sewing machine is known, in particular from the document EP 337 952 A1 comprising a frame having at least two substantially horizontal arms with which are associated at least one needle bar and its drive mechanism, for the first arm, and at least one feeder mechanism for the material to be sewn and/or a loop captor device for the other arm these arms extending out from the side of a connecting column.

In this type of machine, the frame comprises, on the one hand, a structure of synthetic material, for example of plastics, forming a support base of the machine on which stands at least one support plate and, on the other hand, carried by this plate, a strong framework having the general shape of a U, the limbs of which form, respectively, at least a portion of the first and of the second of said arms and the base of which forms at least a portion of the column.

In one of the forms of embodiment described in the European document cited, the structure of synthetic material has a plurality of recesses for positioning of the framework on the structure, the securing of the former to the latter being effected by clamps which embrace the framework at various locations and are detachably fixed to the structure by screws.

Even though this solution offers every guarantee from a purely mechanical point of view, it is in the context of rationalising the assembly that the essential disadvantage comes to light: in effect even though the manner of fixation of the clamps to the structure of synthetic material may seem both economical and simple to carry out, it must be pointed out that, in use, and especially in the context of manufacture and of series assembly of sewing machines, it is a slow operation, since it requires first of all placing the clamps at the locations prescribed, then positioning the securing screws in the passages provided in these clamps, and then proceeding with the screwing of these screws into the body of the structure of synthetic material.

It should also be pointed out that if, at a later stage, the framework thus mounted has to be separated from the structure for replacement by another framework of the same type, for example as a result of a defect in the first or in one or other of the mechanical parts which this framework is required to carry, the attachment of the new framework will, in many cases, be of a lesser quality than that of the original framework, essentially because it will be necessary to rescrew the screws into the same openings in the support, and, as is known, in such a case it is practically impossible to replace these screws exactly in the helical grooves as they were formed during mounting of the original framework.

The present invention aims to obviate these disadvantages.

The accompanying drawings depict, by way of example and very diagrammatically, an embodiment and two variants:

Figure 1:
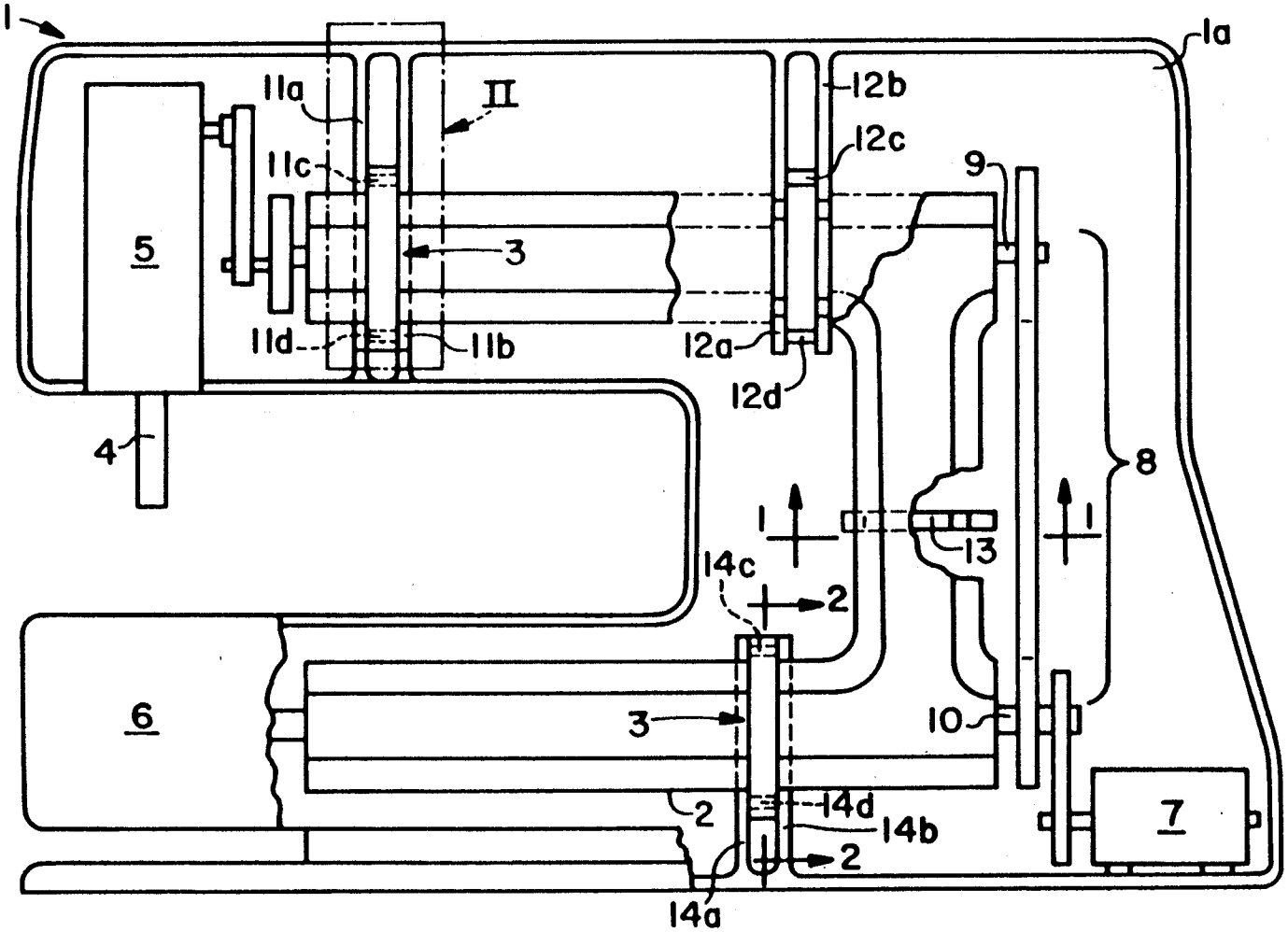
FIG. 1 is a partially cut away elevation.

The sewing machine shown in FIG. 1 has a casing 1 formed by assembly of two shells, such as the shell 1*a*, which also forms one of the two members of the frame of the machine, in the manner described and illustrated in the aforementioned document EP 337 952 A1.

In effect, according to an essential feature both of the machine disclosed by this document and of that according to the present invention, such a frame is formed by the shell 1*a* and by a strong framework in the shape of a U, 2, existing in the present case in the form of a hollow body of hexagonal cross-section, detachably fixed to this shell by three devices indicated generally by reference 3, and the structural features of which will be described in the following text. The positioning of the framework 2 on the support 1*a* is effected by suitably shaped ribs projecting from the base of the support, the structural details of which will be indicated in the following text with reference, in particular, to FIGS. 1, 1A, 1B and 2.

It should, first of all, be noted, that as in the case of the machine forming the subject of the aforementioned earlier European document, the machine depicted in FIG. 1 comprises a needle bar 4, a drive mechanism 5 for the needle bar, a feeder mechanism for the material to be sewn and a loop captor device, both indicated by reference 6, these various elements being simply outlined on the drawing in the form of rectangles.

The assembly of these elements is driven, in traditional manner, by means of a motor 7 through a set of pulleys and drive belts, indicated in general manner by the reference 8, driving two motor shafts 9 and 10, respectively, of which shaft 9 traverses the upper arm of the framework 2 and shaft 10 the lower arm of the framework. Bearings, not shown, facilitate rotation and maintenance of the shafts 9, 10 in a centred and horizontal position in the respective arm of the framework. At their lefthand extremity, in the drawing, the shafts 9 and 10 are coupled to mechanisms 5 and 6 respectively in a manner conventional in this technical field.

It is to be noted that in the sewing machine according to the invention, the framework 2, the shafts 9 and 10, their bearings, and the pulleys fixed to their respective righthand ends, form a self-contained and detachable unit which will preferably be mass produced, even at a location distant from that where final assembly of the machine takes place. This unit may, furthermore, constitute an exchange assembly, in particular intended for "after sales service", which can be called upon to repair a machine according to the invention where, for example, one or other of the bearings carrying the shafts 9 and 10 prove to be defective in operation.

The manner of attachment of the framework 2 to the support which is formed by the shell 1*a* of the casing of the machine allows mounting and removal of this framework, and thus the functional unit assembly mentioned, to be undertaken with ease. Accordingly, each attachment device 3 comprises, in substance, the elements which will now be described.

Figure 1B:
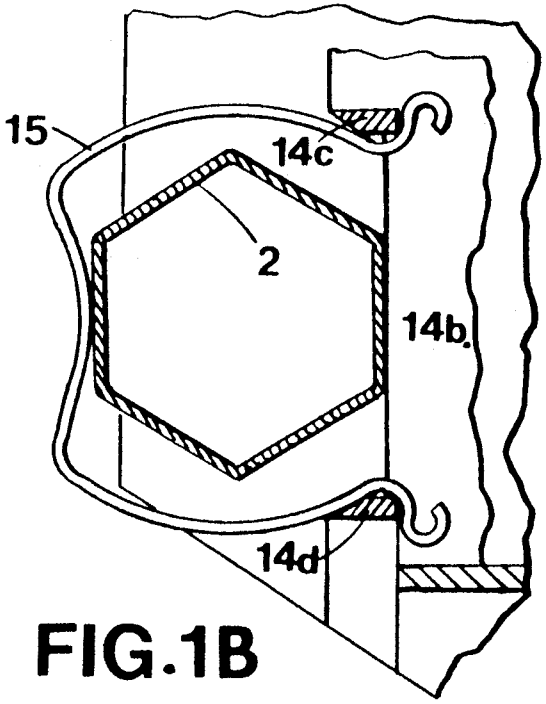
FIG. 1B is a section on the line B—B of this same Figure.

As has already been indicated, the positioning of the framework 2 on the shell 1*a* is assured according to the invention by a series of suitably shaped ribs. In the present case, these are seven in number, namely two identical and vertical pairs of ribs 11*a* and 11*b*, 12*a* and 12*b* respectively, comprised in the upper portion of the shell 1*a* (FIGS. 1 and 2), a horizontal rib 13 for cooperation with the base of the U formed by the framework 2 (FIG. 1A). and a supplementary pair of ribs, 14*a* and 14*b* extending out from the lower part of the shell of the casing (FIG. 1B).

The ribs of each pair of ribs are parallel to each other and are connected two by two by two struts 11*c* and 11*d*, 12*c* and 12*d* 14*c* and 14*d*, for the ribs 11*a*, 11*b*; 12*a*, 12*b*; 14*a*, 14*b*, respectively. The cross-section of these struts is trapezoidal.

Figure 3:
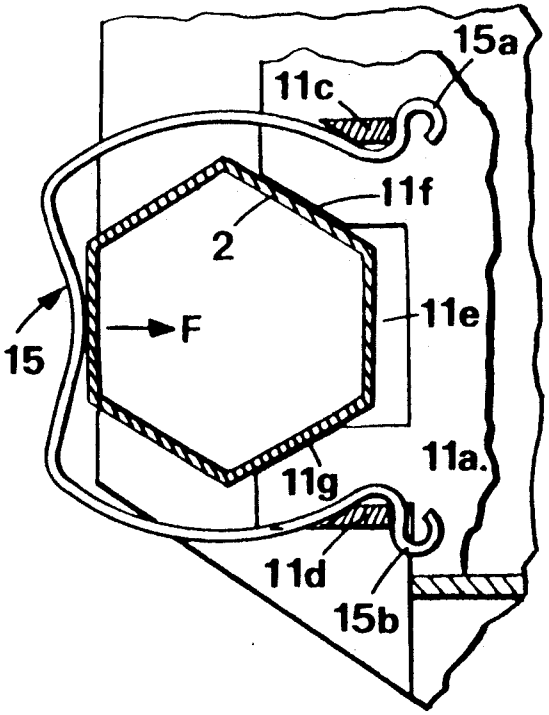
FIG. 3 is a sectional view on the line III—III of FIG. 2

As may be seen in FIG. 3, the rib 11*a* has a recess 11*e* delimiting two support surfaces 11*f* and 11*g*, on the edge of this rib, whose respective inclination and spacing correspond substantially to those of a portion of the external side surface of the upper limb of the framework 2. The ribs 11*b* 12*a* and 12*b* comprise corresponding indentations of the same shape and dimensions. The result of this is that when the framework 2 is placed, as illustrated, in contact with the support surfaces of the assembly of ribs 11*a*, 11*b*, 12*a* and 12*b*, this framework occupies, with respect to the shell 1*a*, a perfectly defined position in the vertical direction in FIG. 1 of the drawing.

Figure 1A:
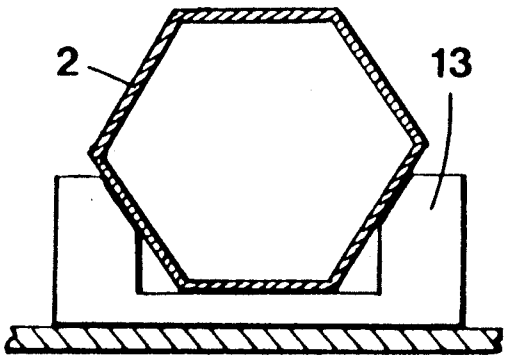
FIG. 1A is a section on the line A—A of FIG. 1
Figure 2:
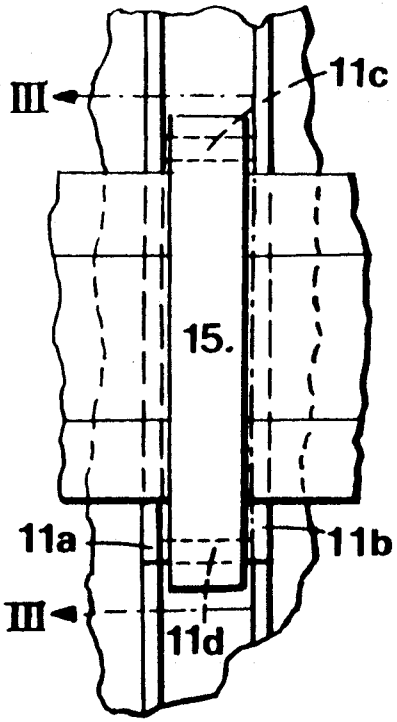
FIG. 2 is a view, to a larger scale, of the portion II of FIG. 1.

The positioning of the framework 2 in the horizontal direction is assured by the aforementioned rib 13 which, as may be seen in FIG. 1A. has an indentation of the same shape and dimensions as those of the ribs 11*a*, 11*b*, 12*a* and 12*b*.

Regarding the ribs 14*a* and 14*b* (FIG. 1B), it should be noted that, contrary to the ribs 11*a* and 11*b*, the portion of these ribs which forms a seat for the lower limb of the framework 2 has a completely rectilinear profile, without any indentation, with the result that the ribs 14*a* and 14*b* only effect positioning of the framework on the support in a direction perpendicular to the plane of FIG. 1 of the drawings (support of the framework 2 against the ribs 14*a* and 14*b* under the action of clip 15).

Figure 3A:
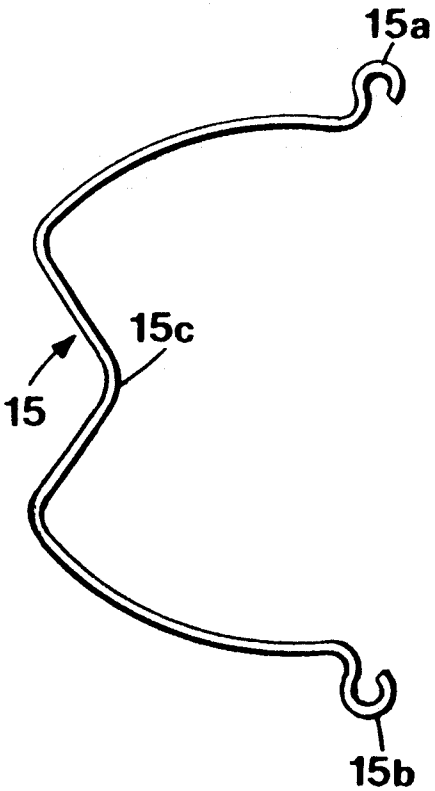
FIG. 3A is a view of a member appearing in FIG. 3.

In the sewing machine according to the invention, once positioned in the manner described, the framework 2 is secured to the support which is formed by the shell 1*a* of the casing by three clamps formed by clips such as the clip 15 depicted in FIG. 3A. These clips are each formed by a section of a metal strip, for example of spring steel, having the general shape of a W, the free ends of which are rolled back at 15*a* and 15*b* to form a sort of hook. Furthermore, in a non-stressed position of the clip, the distance separating these hooks is much greater than that between the aforementioned struts 11*c*, 11*d*; 12*c*, 12*d*; 14*c* and 14*d*.

By way of example, in the embodiment depicted in the drawing, the relationship between the spacing between the hooks 15*a* and 15*b*, and the distance separating the struts 11*c* and 11*d* is of the order of 1.4 approximately: this ratio may, of course, be different depending on the type of material chosen for the clip 15 as well as depending upon the magnitude of the force which it is desired to exert on the framework 2, when the clip is mounted in the manner illustrated in FIG. 3.

Accordingly, it suffices to commence by engaging one of the arms of the clip 15 in the space between the ribs 11*a* and 11*b*, on the one hand, and the strut 11*c* and the framework 2, on the other hand, by a rotational movement in an anticlockwise direction (FIG. 3) until the hook 15*b* comes into a position slightly in front of the strut 11*d*, that is to the left of it in FIG. 3.

The clip, and more particularly its bevelled surface, is brought in contact with the strut 11*c*. It is then tightened by moving the hook 15*b* towards the hook 15*a* until this hook 15*b* comes to take up position opposite the passage delimited by the strut 11*d* and the framework 2. The arm of the clip carrying this hook is then engaged in this passage until the hook finds itself beyond this strut and the clip is allowed to relax to occupy the position illustrated in the drawing. It is to be noted that the dimensions of the clip 15 are such that, in this position, the most projecting portion, 15*c* (FIG. 3A), of the base of the W of the clip, comes to press against the framework 2. At the same time its hooks 15*a* and 15*b* and the portions of its two limbs which are adjacent to them are in close contact with the struts 11*c* and 11*d*.

That which has just been described with reference to the clip mounted between the ribs 11*a* and 11*b* is also true for the two other clips disposed between the ribs 12*a* and 12*b* or 14*a* and 14*b*.

The removal of such a clip may be carried out very simply by proceeding in the reverse manner to that which has been illustrated; commencing by tightening the arms of the clip sufficiently far to bring the hook 15*b* into the space between the strut 11*d* and the framework 2. This arm of the clip is then disengaged from this space by moving it in a clockwise direction while at the same time letting the clip supported by its other arm "pivot" about the strut 11*c*.

The force F exerted by a clip, such as the clip 15, on the framework 2 is of course dependent on its dimensions and on the nature of the material from which it is formed. It must be sufficient to ensure securing of the framework 2 to the shell 1*a* of the casing 1, in the position set by contact with the support surfaces (such as the surfaces 11*f* and 11*g*—FIG. 3) provided for this purpose on the ribs 11*a*, 11*b*, 12*a*, 12*b*, 13 and 14*a*, 14*b*, both during handling and transport of the sewing machine and of course during its operation.

It should, at this point, be noted that in a sewing machine of the type described, the magnitude of the mechanical forces transmitted to the framework 2 by the drive mechanisms for the needle bar or for the loop captor device, for example, is relatively low and that the component of these forces which is transferred to the mounting clips is also modest, so that such a clip may for example be formed by shaping of a section of spring-steel strip, of a thickness of the order of 4 to 5 tenths of a mm and of a width of the order of approximately ten millimetres. The overall dimensions of a clip may be 7 to 8 centimetres wide (distance at the level of the hooks) and 4 to 5 centimetres high.

Figure 4:
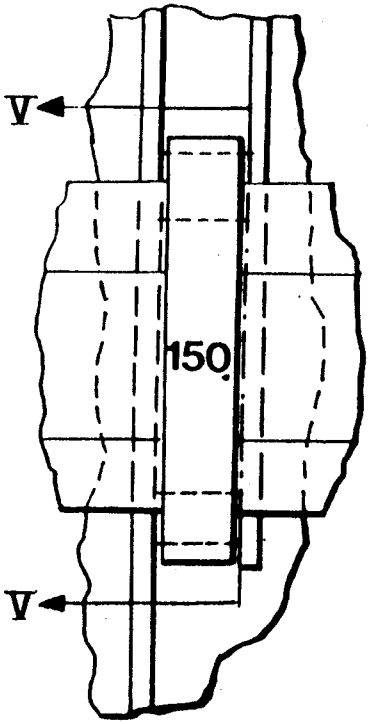
FIG. 4 is a view similar to that of FIG. 2 depicting a first variant of an embodiment of a portion of the sewing machine according to the invention.
Figure 5:
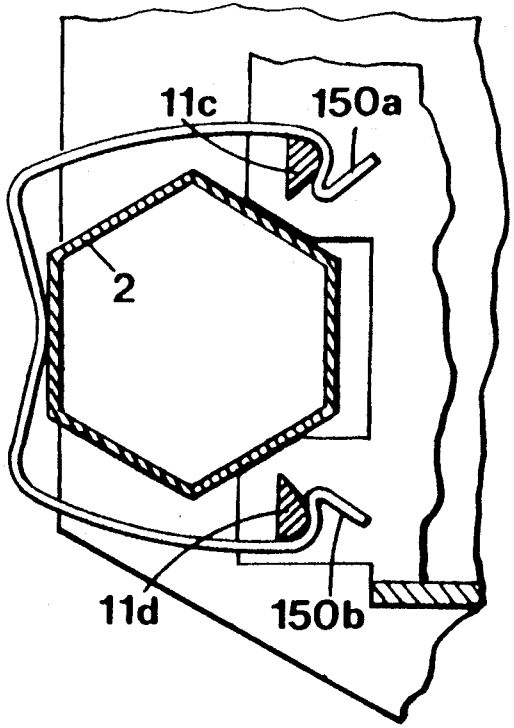
FIG. 5 is a sectional view on the line V—V of FIG. 4
Figure 5A:
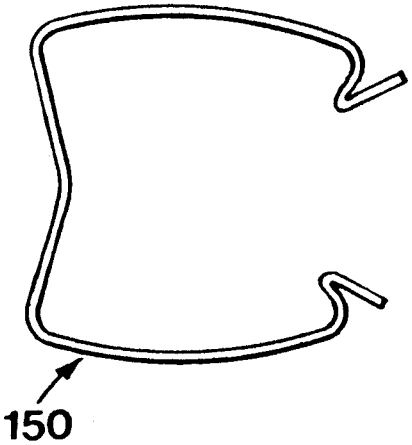
FIG. 5A is a view of a member appearing in FIG. 5.

In the embodiment which is the subject of FIGS. 4, 5 and 5A. the mounting of the framework 2 is also assured by resilient clips such as the clip 150 (FIG. 5A).

Such a clip, which also has substantially the general shape of a W, comprises at the free ends of its two arms two portions 150*a* and 150*b*, folded back in a V, to form sorts of hooks by means of which the clip surrounds and engages against the side and rear surfaces of the previously mentioned struts 11c and 11d. In effect, and contrary to that which was the case for the clip 15 (FIG. 3A), the clip 150 of the present variant is mounted by moving the two arms apart, for example by first of all placing the "hook" 150a in engagement with the strut 11c and then by tilting the clip in a pivotal movement in the anticlockwise direction about this strut while separating the two arms of the clip sufficiently to allow the "hook" 150b to pass under and behind the strut 11d. The clip is then allowed to relax slightly so that it occupies the position illustrated in FIG. 5.

Of course, the three securing clips comprised in the sewing machine according to the invention are of identical structure and are mounted in the same way.

Figure 6:
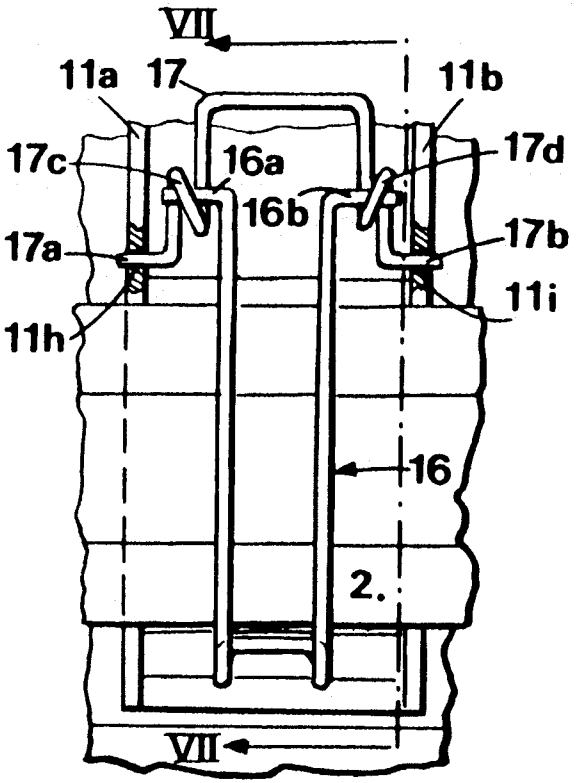
FIG. 6 is a view similar to that of FIG. 2 depicting a second variant in embodiment.
Figure 7:
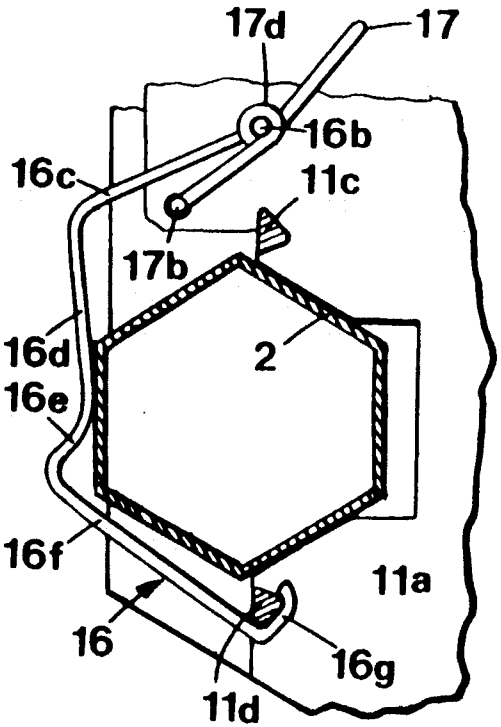
FIG. 7 is a sectional view on the line VII—VII of FIG. 6
Figure 7A:
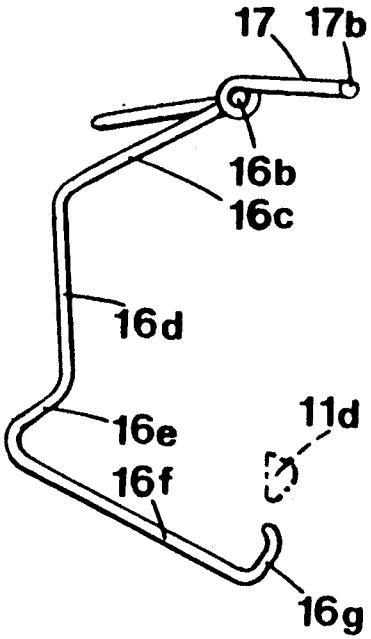
FIG. 7A shows a member appearing in FIG. 7. in another working position.

In the variant illustrated in FIGS. 6, 7 and 7A, each device for attachment of the framework 2 to the shell 1a of the casing of the machine comprises substantially two principal parts, namely a tightening strap 16 and a control lever 17.

The lever 17 is formed by a U-shaped brace formed from wire, for example of metal, the free ends of the arms of which are bent at 90°, 17a and 17b. An intermediate portion of each free end is folded back on itself to form respective loops 17c and 17d (FIG. 6). This lever 17 is engaged by its ends 17a and 17b in openings 11h and 11i traversing the ribs 11a and 11b, respectively, and forming a "bearing" for the lever 17. This lever may then be tilted by pivoting of its ends 17a and 17b in said openings 11h and 11i.

In the manner of the lever 17, the strap 16 is also formed by a wire-form brace in the shape of a U, the free ends 16a and 16b of which are bent at 90 degrees and are pivotingly mounted by engagement, with play, in the loops 17c and 17d, respectively, of the lever 17. The strap may thus be pivoted with respect to this lever while at the same time following the lever when the lever itself is pivoted.

As may be seen clearly in FIG. 7, each of the arms of the U of the strap 16 is subdivided into five sectors 16c, 16d, 16e, 16f and 16g. It is in fact this strap which is intended to ensure the maintaining of the framework 2 on the shell 1a of the casing of the sewing machine, in particular when the strap is brought to and fastened under tension in the position which it occupies in FIG. 7. in which the portion 16g, bent in the form of a hook, grips on the aforementioned strut 11d; the sections 16d and 16e of the strap are thus in contact with the framework 2 and exert on this the force necessary to ensure the positioning of this framework on the previously mentioned support surfaces 11f and 11g and its attachment to the shell 1a of the casing 1 of the machine.

In particular it may be seen that, in such a case, this position of the strap 16 is a stable position, in that the notional plane passing through both the zone of contact of the arms of the strap 16, in particular the sections 16d and 16e of each arm, with the frame ? and also through the longitudinal axis of the bent portions 16a and 16b of these arms, that is to say substantially through the axis of pivoting of this strap in the loops 17c and 17d of the control lever 17, is located to the righthand side, in the drawing (FIG. 7), of the longitudinal axis of the bent portions, 17a and 17b, of this lever, that is to say through the axis of pivoting of the lever 17 with respect to the ribs 11a and 11b.

The portion of the strap 16 starts to become unstable from the moment when, by tilting the lever 17 in an anticlockwise direction, the notional plane hereabove passes through the axis of pivoting of this lever and goes beyond it, to a location to the lefthand side of this in the drawing (FIGS. 7A). As the tilting of the lever 17 is accompanied by a circular movement (identical in direction to that of this tilting) of the portions 16a and 16b of the strap 16 about the axis of pivoting of the lever 17, this movement results, first of all, in an increase in the tension exerted on the strap 16 and thus in a temporary elongation of this, this during the "ascending" phase of the displacement of the portions 16a and 16b of the strap, that is to say while these portions of the strap are being displaced to a higher level in the drawing from that which they occupy in the position illustrated in FIGS. 6 and 7. This elongation will be followed by a release of this tension and thus by a reduction in the overall length of the strap during the "descending" phase of said displacement, that is from when the portions 16a and 16b of the strap are displaced to a level below that of the position illustrated in FIGS. 6 and 7.

From the moment when the strap 16 is no longer under tension and its portions 16a and 16b occupy a sufficiently low position with respect to the axis of pivoting of the lever 17, the hook-form section 16g of the strap will leave the strut 11d so that the gripping device described will no longer have a hold on the framework 2.

That which has just been described, with reference to a single attachment device 3 (16, 17) for the framework which is situated between the ribs 11a and 11b, is also true for the two other devices attached, in a similar manner, to the pairs of ribs 12a, 12b and 14a, 14b and intended to take a hold respectively on the struts 12d and 14d which are integral with these ribs (FIG. 1). It thus suffices to place the three devices 3 in the "open" position, such as that partially and diagrammatically illustrated in FIG. 7A, to allow removal of the framework 2 from the shell 1a of the machine.

As a corollary, this framework will be correctly positioned on the shell 1a by simply placing its two horizontal limbs and its vertical portion connecting these limbs on the support surfaces provided on the ribs 11a and 11b, 12a and 12b, 13, 14a and 14b. The attachment of the framework 2 to this shell is obtained by making use of the three gripping devices in the manner previously described.

The invention is not, of course, limited to that which has been described and depicted: in particular, it is evident that it would be possible to obtain the positioning and attachment of the framework 2 to the shell 1a of the casing of the sewing machine by using "clips" of different shape and/or structure to those illustrated in the drawings.

Likewise, use could be made of a different number of clips and pairs of ribs (such as those indicated by the references 11a, 11b; 12a, 12b; 14a, 14b) from those used in the construction of the machine depicted. In a similar manner, the number of positioning ribs (such as the horizontal rib 13) associated with the portion of the shell 1a which forms a part of the "column" of the casing of the machine, could be greater than one.

We claim:

1. A sewing machine comprising a frame having a column carrying substantially horizontal first and second arms, the first arm extending above the second arm, a needle bar and a first drive mechanism for said needle bar being associated with the first arm, a first device for feeding the material to be sewn, a second loop captor device and a second drive mechanism for said devices being associated with the second arm, said frame comprising a structure including a base and a support in the form of a U standing on the base and having a first and a second limb, extending parallel, one above the other, as well as an intermediate section connecting corresponding ends of the first and second limbs, said first and second limbs of the support forming at least a portion of said first and second arms of the frame, respectively, a framework in the form of a U having a third and a fourth limb and at least one connecting element for the third and fourth limbs, means assuring the positioning of the third and the fourth limbs of the framework on the first and the second limb of the support, respectively, a plurality of clamps for securing the third and fourth limbs of the framework on said first and second limbs of the support in a position defined by said means, each clamp comprising gripping members cooperating with corresponding securing members integral with said first and second limbs of the support, wherein said means comprise, a first and a second series of pairs of ribs integral with the first and a second limbs of the support, respectively, the ribs of each pair of ribs being spaced from one another and being transversely oriented to the longitudinal axis of said limbs of the support, said securing members being integral with said ribs, and at least one supplementary rib, integral with said intermediate section of the support, oriented in a direction transverse to the axis of orientation of the ribs of said first and second series of pairs of ribs, each of said ribs having an indentation opening onto a portion of a length of an edge surface and at least a portion of a side of the indentation forming a seat for said portion of said third limb of the framework, for the ribs of said first series, for a portion of said fourth limb of the framework, for the ribs of said second series, and for a portion of said connecting element of the framework, for said supplementary rib, respectively, each clamp being disposed in the space between the ribs of a predetermined pair of ribs, and being engaged by said gripping members with the securing members of the ribs of said predetermined pair.

2. A machine according to claim 1, wherein each clamp is formed by a strip-form element of a resiliently deformable material, the ends of which are folded back in the form of hooks and form said gripping members, and said securing members are formed by a pair of struts on which said hooks of the clamp take hold, one end of each strut being integral with the first of the two ribs between which the clamp is situated and the other end being integral with the second of these ribs, said struts being disposed one at each side of the indentation in each rib.

3. A machine according to claim 1, wherein each clamp is formed by a first lever for tightening the clamp, and by a second lever, controlled by the first lever, said first lever having the general shape of a U and comprising a fifth and a sixth limb jointed by a second connecting element for the fifth and sixth limbs, the ends of said fifth and sixth limbs being bent and pivotingly engaged in passages provided in each rib of the pair of ribs between which the clamp is situated, and a median portion of said fifth and sixth limbs of said lever being rolled up on itself to form a loop having at least one coil, said second lever also having the form of a U comprising a seventh and an eighth limb, joined together by a third element connecting the seventh and eighth limbs, and a first free end of said second lever, being the free end of said seventh limb, being bent and pivotingly engaged in an opening of the loop of said fifth limbs, and the free end of said eighth limb being bent and pivotingly engaged in an opening of the loop of said sixth limb, the second ends of said seventh and eighth limbs of said second lever being bent back to form a gripping hook in cooperation with said third connecting element, and the ribs of each of said pairs of ribs being connected to one another by a common strut forming said securing member for said hook in a tightened position of the clamp.

* * * * *